US011167898B2

(12) United States Patent
Mussell et al.

(10) Patent No.: US 11,167,898 B2
(45) Date of Patent: Nov. 9, 2021

(54) PACKAGING FILM WITH PRODUCT-RELEASE COATING

(71) Applicant: BEMIS COMPANY, INC., Neenah, WI (US)

(72) Inventors: Chris S. Mussell, New London, WI (US); Nathan T. Mocadlo, Appleton, WI (US)

(73) Assignee: Bemis Company, Inc., Neenah, WI (US)

( * ) Notice: Subject to any disclaimer, the term of this patent is extended or adjusted under 35 U.S.C. 154(b) by 581 days.

(21) Appl. No.: 15/120,946

(22) PCT Filed: Mar. 12, 2014

(86) PCT No.: PCT/US2014/023982

§ 371 (c)(1),
(2) Date: Aug. 23, 2016

(87) PCT Pub. No.: WO2015/137933

PCT Pub. Date: Sep. 17, 2015

(65) Prior Publication Data

US 2016/0362237 A1 Dec. 15, 2016

(51) Int. Cl.

| | |
|---|---|
| ***B65D 65/42*** | (2006.01) |
| ***B65D 65/14*** | (2006.01) |
| ***B65D 75/30*** | (2006.01) |
| ***B65D 75/44*** | (2006.01) |

(52) U.S. Cl.

CPC ..... *B65D 65/42* (2013.01); *B65D 65/14* (2013.01); *B65D 75/30* (2013.01); *B65D 75/44* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,348,455 | A * | 9/1982 | Clayton | C08J 7/065 427/208.2 |
| 4,467,073 | A | 8/1984 | Creasy | |
| 4,719,235 | A | 1/1988 | Kern | |
| 4,927,647 | A | 5/1990 | Bailey | |
| 5,415,935 | A | 5/1995 | Pankratz | |
| 5,616,400 | A * | 4/1997 | Zhang | A61L 15/58 428/195.1 |

(Continued)

FOREIGN PATENT DOCUMENTS

WO 2004037646 A2 5/2004

*Primary Examiner* — Laura C Powers
(74) *Attorney, Agent, or Firm* — Amy L. De Coster

(57) ABSTRACT

The present invention relates packaging webs having at least one surface comprising a product-release coating composition which is capable of easily separating from a food product without tearing the web or changing the appearance of the food product, where the product-release coating composition includes a compound of the following formula (I):

(I)

13 Claims, 9 Drawing Sheets

(56) References Cited

U.S. PATENT DOCUMENTS

| | | | | |
|---|---|---|---|---|
| 5,736,249 | A | 4/1998 | Smith et al. | |
| 5,965,226 | A * | 10/1999 | Muschelewicz | B32B 7/12 428/220 |
| 5,993,962 | A | 11/1999 | Timm et al. | |
| 6,099,682 | A * | 8/2000 | Krampe | B65D 75/5855 156/272.6 |
| 6,433,053 | B1 * | 8/2002 | Kasturi | C11D 3/18 428/537.5 |
| 6,613,430 | B2 | 9/2003 | Culbertson et al. | |
| 7,235,294 | B2 | 6/2007 | Story | |
| 7,569,279 | B2 | 8/2009 | Longmoore | |
| 8,129,032 | B2 | 3/2012 | Dabadie et al. | |
| 8,445,100 | B2 | 5/2013 | Forshey et al. | |
| 8,563,140 | B2 | 10/2013 | Dellinger et al. | |
| 2004/0224174 | A1 | 11/2004 | Shoop et al. | |
| 2006/0257596 | A1 | 11/2006 | Catalfamo et al. | |
| 2011/0152052 | A1 | 6/2011 | Schumacher et al. | |
| 2013/0118128 | A1 | 5/2013 | Luecke et al. | |
| 2014/0016884 | A1 | 1/2014 | Exner et al. | |

* cited by examiner

PACKAGING FILM WITH PRODUCT-RELEASE COATING

BACKGROUND OF THE INVENTION

The present invention relates generally to packaging material and more particularly relates to packaging materials for use in packaging foods, with improved release properties.

It is desirable to wrap certain foods in a packaging material prior to distribution. However, various types of foods tend to be hydroscopic in nature, for example some types of candy, chocolates, or baked goods, such as nutrition or breakfast bars, and stick or cling to the packaging material when the consumer attempts to remove the packaging material prior to consumption due to moisture absorption by the food. Such sticking or clinging is undesirable in that it may lead to food wastage or tearing of the packaging material.

Various materials have been used on the interior surface of packaging materials to prevent blocking. Blocking is defined as undesired adhesion between touching layers of a packaging material such as occurs under moderate pressure conditions which occur during storing or wrapping operations. For example, it is known to provide a thin coating of dry granular starch on the packaging material. Such coating of dry granular starch, however, is not satisfactory in effecting release of the packaging material from the food product that is wrapped therein.

Accordingly, it is an object of the present invention to provide an improved packaging material. It is another object of the present invention to provide a packaging material with improved release properties when used for food products. It is further object of the present invention to provide a coating which provides easy release of the packaging material from the food products at the time of consuming.

These and other objects of the present invention will become more clear from the following detailed disclosure.

SUMMARY OF THE INVENTION

The present invention is directed to packaging webs having at least one surface comprising a product-release coating composition which is capable of easily separating from a food product without tearing the web or changing the appearance of the food product, where the product-release coating composition includes a compound of the following formula (I):

(I)

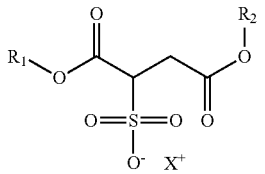

wherein $R_1$ and $R_2$ are each independently a straight, branched or cyclic alkyl group having from 1 to 13 carbon atoms, and $X^+$ is a metal cation selected from Al, Ca, Mg, K or Na.

Another embodiment of the present invention is directed to a packaging web which will inhibit moisture loss or absorption by the food product contained therein which includes at least one surface having a product-release coating composition comprising a compound of the above Formula (I).

A further embodiment of the present invention is directed to a packaging web having a controlled product release strength provided by a printable product-release coating composition comprising a compound of the above Formula (I).

BRIEF DESCRIPTION OF THE DRAWINGS

Further features and advantages of the present invention will become apparent from the following detailed description, taken in combination with the appended drawings, in which.

DETAILED DESCRIPTION OF THE INVENTION

The product-release coating composition of the present invention includes a compound of the following formula (I):

(I)

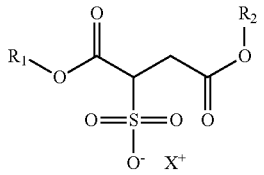

wherein the compound illustrated above is a sulfosuccinate that includes $R_1$ and $R_2$ groups which are each independently a straight, branched or cyclic alkyl group having from 1 to 13 carbon atoms, and $X^+$ is a metal cation selected from Al, Ca, Mg, K or Na. The $R_1$ and $R_2$ can be the same or different. Preferably, however, $R_1$ and $R_2$ will be the same. Preferably, $R_1$ and $R_2$ groups include isobutyl, pentyl (amyl), cyclohexyl, octyl and tridecyl. In a preferred embodiment of the present invention, $X^+$ is Na Preferably, the product-release coating composition includes at least one sulfosuccinate sodium salt of the following formulae (II)-(VI).

(II)

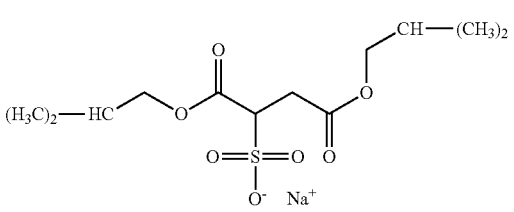

(III)

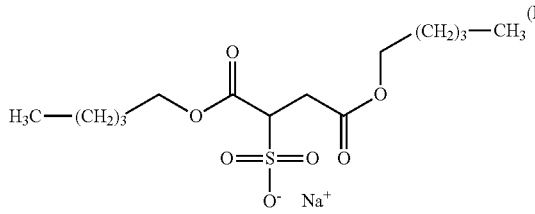

(IV)

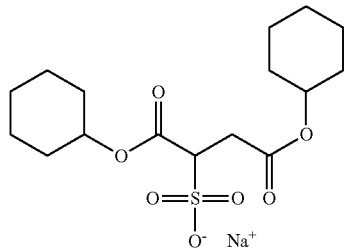

(V)

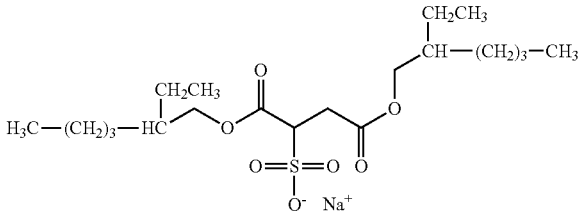

(VI)

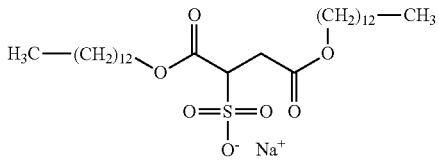

The chemical name of the compound of formula (II) is sodium diisobutyl sulfosuccinate formula (III) is sodium d pentyl sulfosuccinate or sodium dianyl sulfosuccinate; formula (IV) is sodium dicyclohexyl sulfosuccinate; formula (V) is sodium dioctyl sulfosuccinate; and formula (VI) is sodium ditridecyl sulfosuccinate. A non-limiting example of a commercially available product-release coating composition of formula (V) is INXClear anti-fog 1309444 supplied by INX International Ink Company (Appleton, Wis., U.S.A.). In a preferred embodiment, the product-release composition is a mixture of a 7% (wt.) INXClear anti-fog 1309444 and 93% (wt) ethanol. After applying the product-release composition to the packaging web, it is dried to remove any residual solvent. Other commercially available sulfosuccinate compounds contemplated for use in the present invention include those sold under the trademark TRITON™ supplied by the Dow Chemical Company (Midland, Mich., U.S.A.), Nekal Wt-27 supplied by Phenomenex Inc. (Torrance, Calif., U.S.A.); AEROSOL TR, OT, GPG and PG families of surfactants supplied by Cytec Industries (Woodland Park, N.J., U.S.A.); and those sold under the trademark ASTROWET® supplied by Arkem Speciality Polymers (Kwazulu Natal, South Africa).

Figure 1:
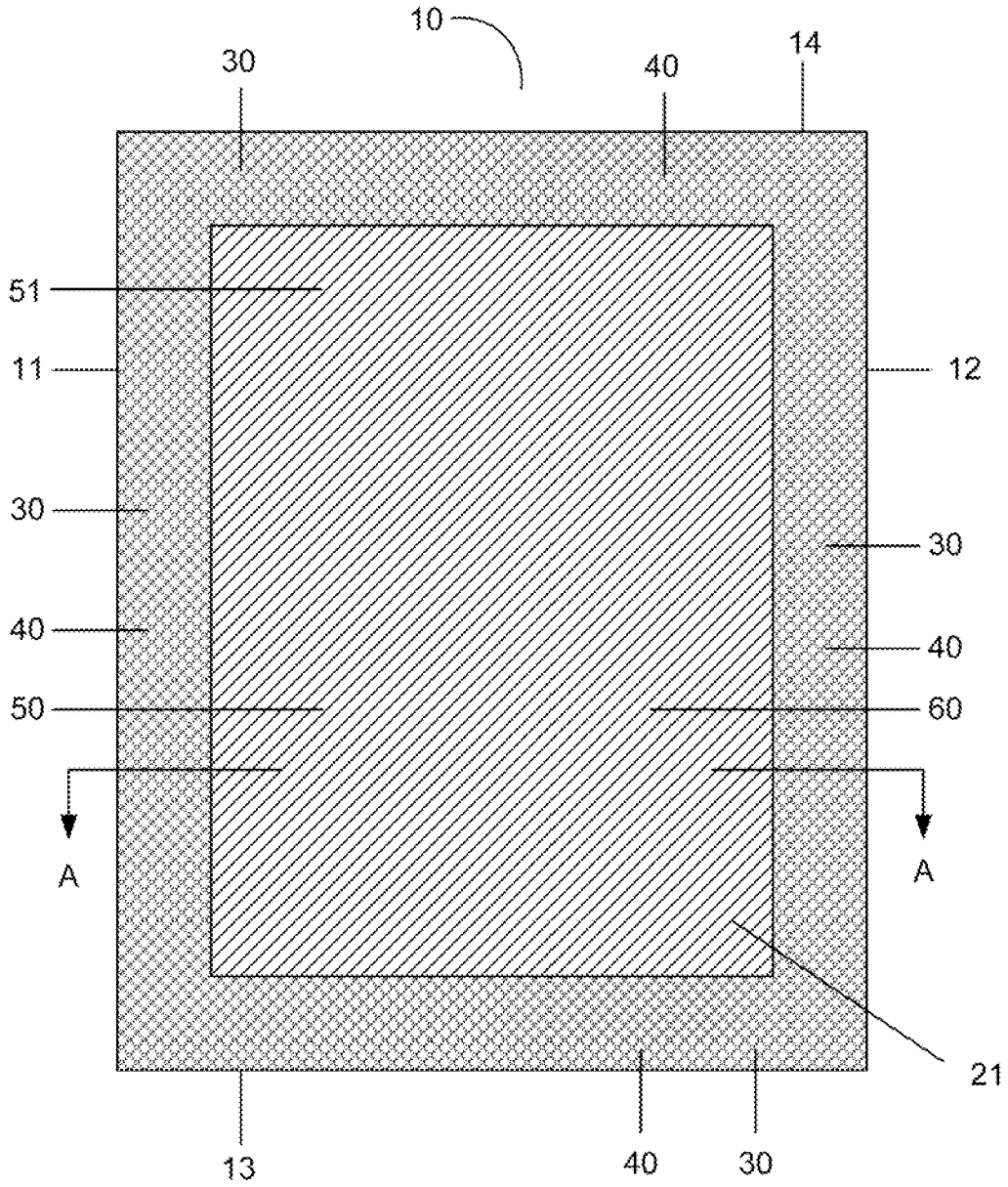
FIG. 1 illustrates a schematic view of one embodiment of a packaging web according to the present invention.

In accordance with the practice of the present invention, a representative packaging web as described herein is shown in FIG. 1. Packaging web 10 comprises a first side edge 11 and an opposing second side edge 12, a third side edge 13 and opposing fourth side edge 14, and an inner surface 21 and an outer opposing surface 22 (not shown). Web 10 also includes a sealing border 30 positioned adjacent to the first, second, third and fourth side edges which comprises a cold-seal adhesive coating 40 and a product-release coating 50 applied in an area 60 circumscribed by the sealing border 30. In a preferred embodiment, product-release coating 50 is present on the inner surface 21 of web 10 in an amount of between 0.02 lb/ream and 0.50 lb/ream (9 gram/ream and 227 gram/ream). It should be understood that the range of amounts of product-release coating 50 present on the inner surface 21 represents its dried weight (or % solids after deposition and drying).

Inner surface 21 of web 10 may be formed from any substrate which includes, but is not limited to, mono-layer or multilayer thermoplastic films which will be described in more detail below. Cold-seal adhesives are an established class of commercial adhesives characterized by being coated onto plastic films or other substrates to form layers that have the capability of strongly bonding to themselves when pressure is applied, but lacking adhesion to low energy surfaces, e.g., plastic films, coated papers, etc. In some cases, such flexible webs bearing these cold-seal adhesives layers may be formed into rolls without significant blocking, i.e., without sticking together. Cold-seal adhesives are based on mixtures of natural and/or synthetic rubber and are well known in the art. These mixtures can be water and/or solvent based rubber compositions. Preferably, cold-seal adhesive coating 40 and a product-release coating 50 are each applied to inner surface 21 of web 10 by standard printing methods known in the art, including flexographic and rotogravure printing techniques. In a preferred embodiment, cold-seal adhesive coating 40 is printed on inner surface 21 of web 10 in registration with product-release coating 50 and graphics printed on opposing surface 22 in a succession printing operations. Non-limiting examples of suitable cold-seal adhesive coatings include COSEAL™ 30080M which is a water based emulsion adhesive formulation supplied by Rohm and Haas Company (Elgin, Ill., U.S.A.); LIOFOL CS® 22-861US1 which is a water based natural rubber latex adhesive supplied by Henkel Corporation (Buffalo, N.Y. U.S.A.); and TURBO-SEAL® C2978B and C7222 adhesives both supplied by Bostik, Inc. (Wauwatosa, Wis., U.S.A.).

Figure 2:
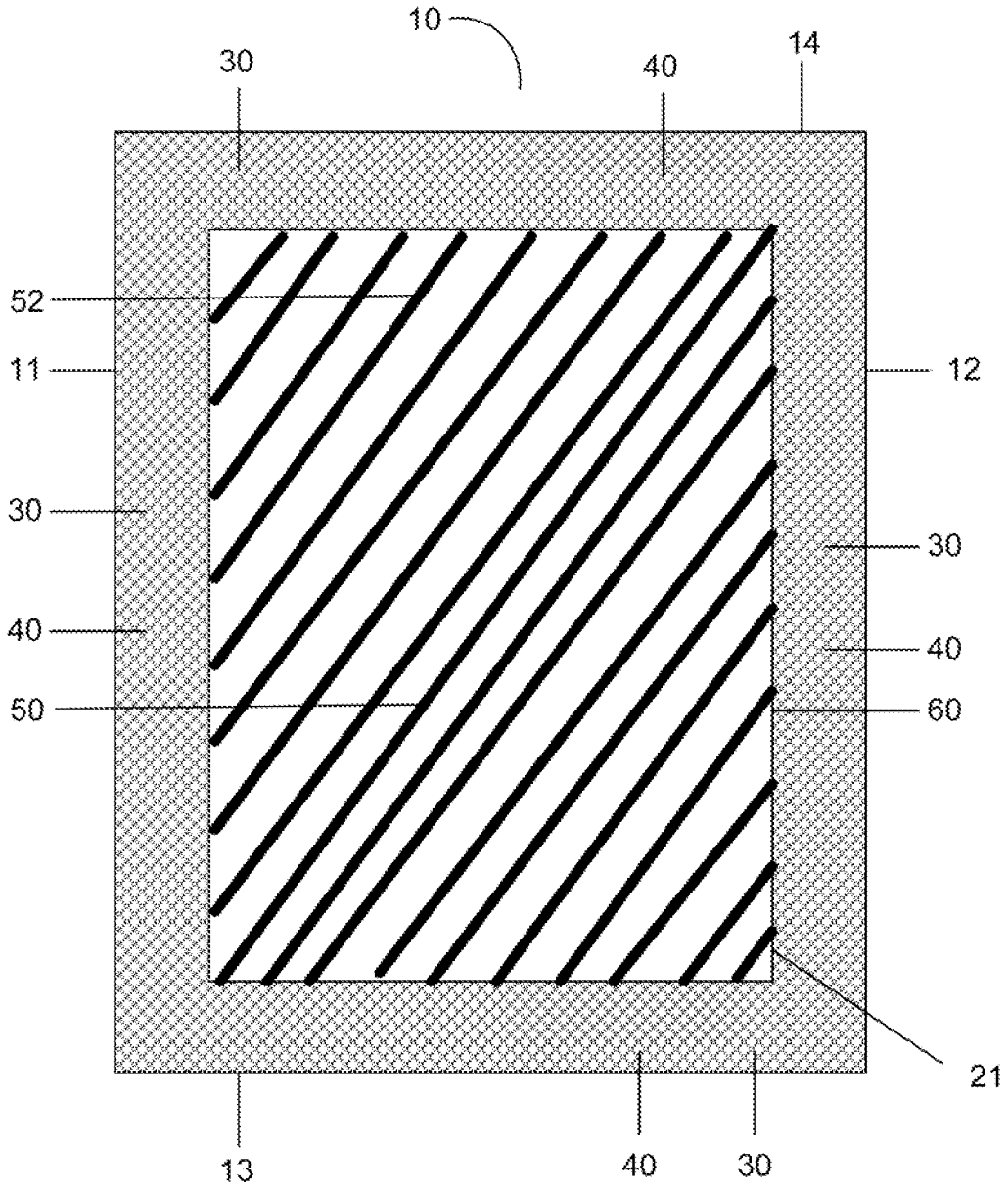
FIG. 2 illustrates a schematic view of another embodiment of a packaging web according to the present invention.

Sealing border 30 may be printed as a contiguous or non-contiguous strip of cold-seal adhesive coating 40 extending around the periphery of web 10 FIG. 1 depicts one embodiment comprising a sealing border 30 having a contiguous strip of cold-seal adhesive coating 40. The width of a contiguous strip of cold-seal adhesive coating 40 may vary depending upon the size and shape of the product. In one preferred embodiment, the contiguous strip of cold-seal adhesive coating 40 has a width of between 0.5 in and 0.63 in (12.7 mm and 15.88 mm). Although web 10 is depicted as having a rectangle shape in FIGS. 1, 2, 4, and 7, it should be understood that web 10 may have any shape depending upon the size and shape product packaged therein. As illustrated in FIG. 1, product-release coating 50 may be applied as a contiguous pattern 51 covering the entire area 60 encompassed by sealing border 30. Alternatively, product-release coating 50 may be applied as a non-contiguous pattern 52 covering the entire area 60 encompassed by sealing border 30 as illustrated in FIG. 2. Such non-contiguous coating may include a pattern of multiply strips, blocks, circles or dots and combinations thereof printed in registration onto inner surface 21 of web 10.

In at least one embodiment, inner surface 21 of web 10 is formed from a polymer layer 25 of polyamide, polyethylene, polyethylene terephthalate or polypropylene. In one embodiment, web 10 will be a mono-layer film having a polymer layer of polyamide, polyethylene, polyethylene terephthalate or polypropylene. Alternatively, web 10 will be a multilayer film having an inner surface 21 formed from a polymer layer 25 (see FIG. 3) of polyamide, polyethylene, polyethylene terephthalate or polypropylene. In a preferred embodiment, the polymer layer is an oriented polyamide, oriented polyethylene terephthalate or oriented polypropylene. Exemplary of commercially available oriented polypropylene free-standing films include those sold under the trademark Bicor™ supplied by Jindal Films, Films Americas LLC (Albany, N.Y., U.S.A.). One particular example of such films include Bicor™ 75 CSR-2 which is characterized as a 0.75 mil (19.05 μm) film designed for cold seal release.

Figure 3:
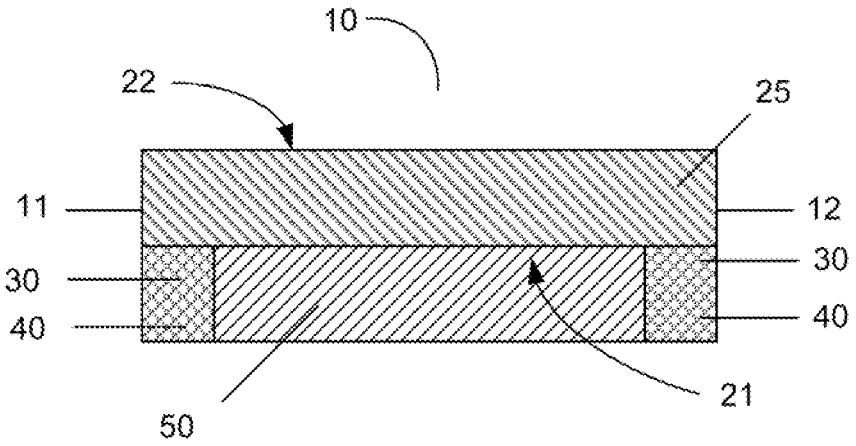
FIG. 3 illustrates a transverse cross-sectional view of one embodiment of a packaging web illustrated in FIG. 1, taken through section A-A of FIG. 1
Figure 4:
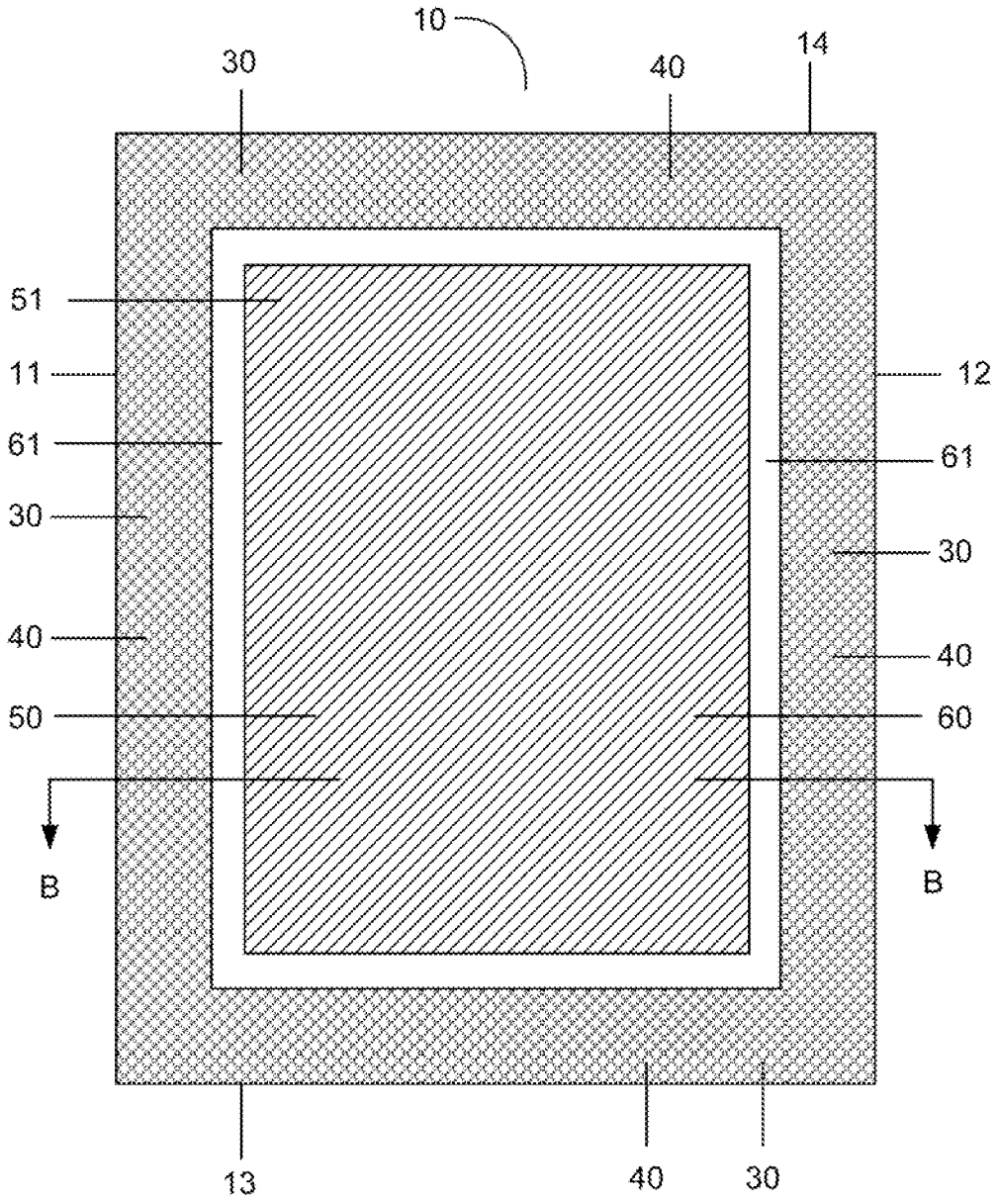
FIG. 4 illustrates a schematic view of another embodiment of a packaging web according to the present invention.
Figure 5:
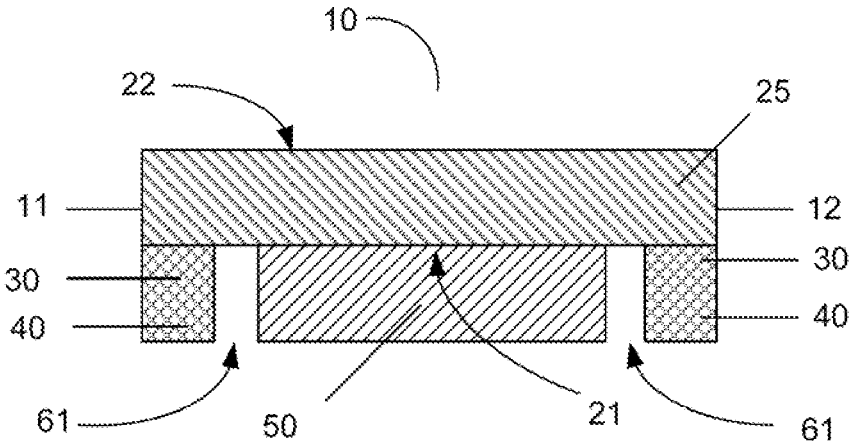
FIG. 5 illustrates a transverse cross-sectional view of one embodiment of a packaging web illustrated in FIG. 4, taken through section B-B of FIG. 4.
Figure 6:
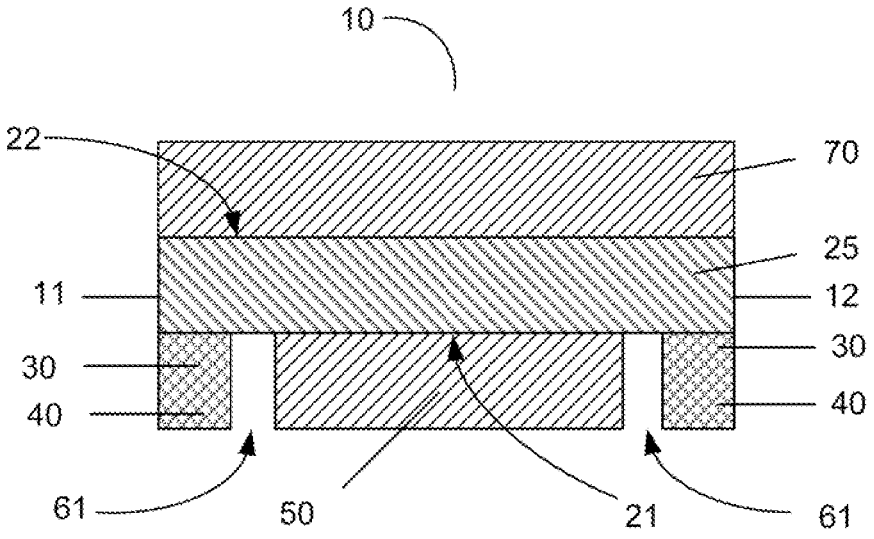
FIG. 6 illustrates a transverse cross-sectional view of another embodiment of a packaging web illustrated in FIG. 4, taken through section B-B of FIG. 4.

FIG. 3 illustrates a cross-sectional view of packaging web 10 taken along line A-A of FIG. 1 depicting polymer layer 26, cold-seal adhesive coating 40 positioned adjacent to first side edge 11 and an opposing second side edge 12, and a product-release coating 50 therebetween. In this embodiment, the product-release coating 50 abuts with sealing border 30 (see also FIGS. 1 and 2). Alternatively, in some embodiments, inner surface 21 may have an adhesive-free margin 61 separating the sealing border 30 from the product-release coating 50 as is illustrated in FIG. 4. FIG. 5 illustrates a cross-sectional view of packaging web 10 having the adhesive-free margin 61 taken along line B-B of FIG. 4. Because the release properties of product-release coating 50 may interfere with the adhesive properties of the cold-seal adhesive coating 40, margin 61 significantly reduces the risk of mixing of these two materials. In some embodiments, it may be beneficial to include an additional cold-seal adhesive release layer 70 such as a cold-seal release coating on opposing surface 22 of web 10 as illustrated in FIG. 6. FIG. 6 illustrates a cross-sectional view of packaging web 10 taken along line B-B of FIG. 4. In this illustration, web 10 includes an adhesive-free margin 61, product-release coating 50 and cold-seal adhesive coating 40 on inner surface 21, and cold-seal adhesive release layer 70 on opposing surface 22.

Figure 7:
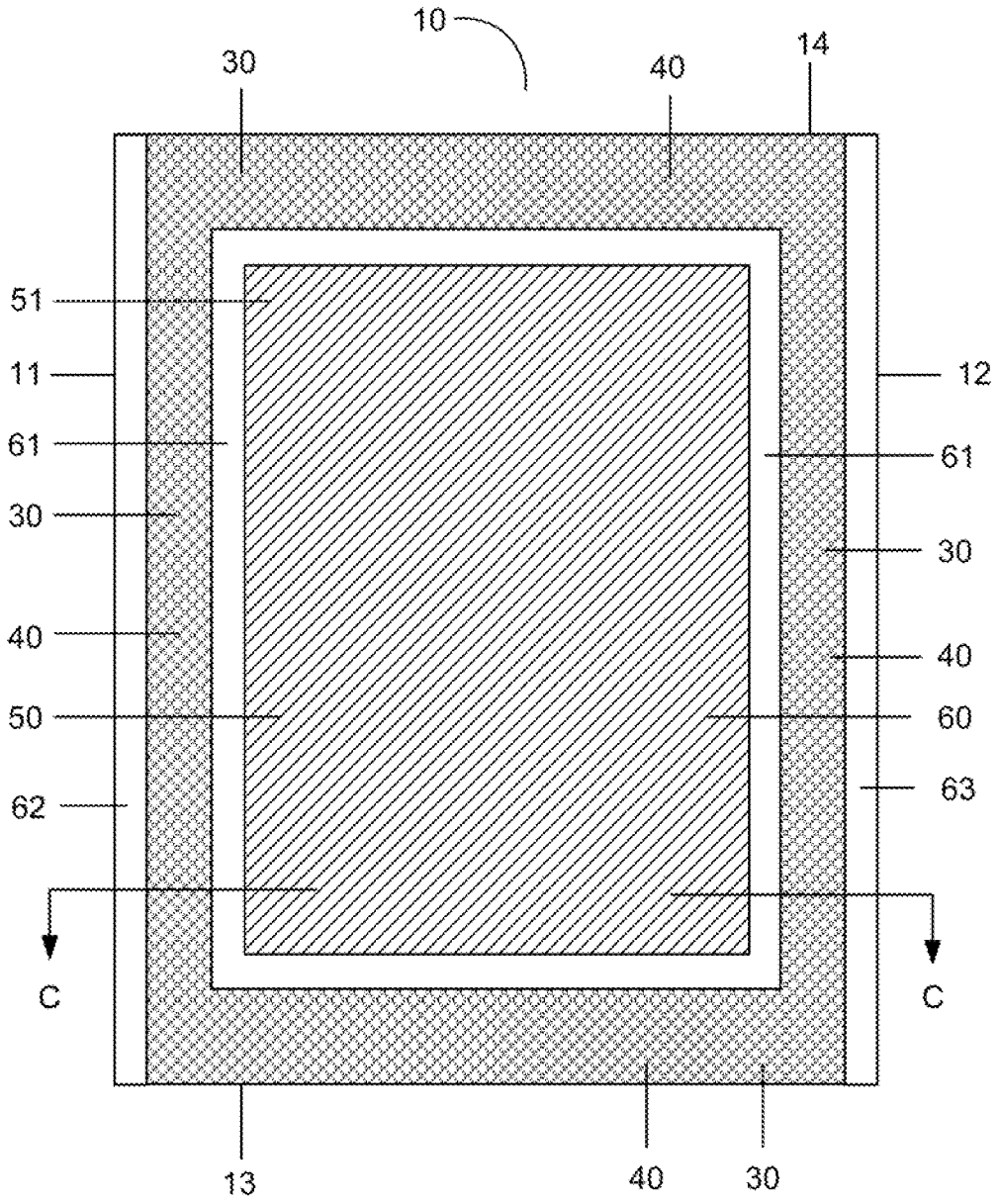
FIG. 7 illustrates a schematic view of another embodiment of a packaging web according to the present invention.

It is also contemplated the inner surface 21 of web 10 may further include a second adhesive-free margin 62 separating the first side edge 11 and the sealing border 30, and a third adhesive-free margin 63 separating the opposing second side edge 12 and the sealing border 30 as illustrated in FIG. 7.

Figure 8:
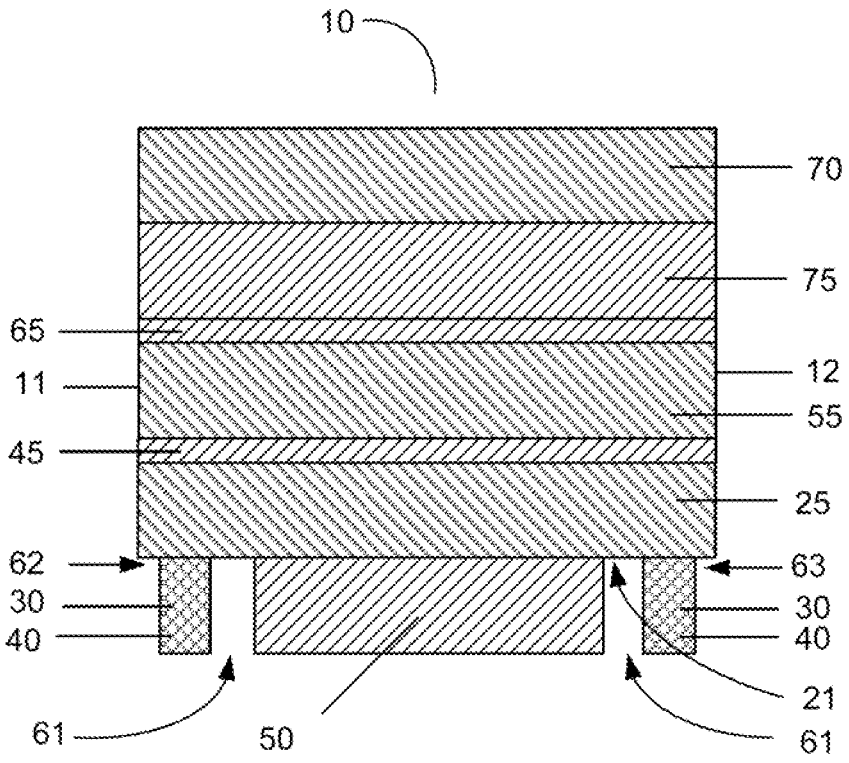
FIG. 8 illustrates a transverse cross-sectional view of another embodiment of a packaging web illustrated in FIG. 7, taken through section C-C of FIG. 7.

In some embodiments, that various combinations of layers can be used in the formation of packaging webs according to the invention. Since the inventive webs may advantageously be used to hold oxygen or moisture sensitive articles, it is preferred to use a combination of layers which includes one or more oxygen and/or moisture barrier layers. The terms "barrier" or "barrier layer" as used herein means a layer of a multilayer web which acts as a physical barrier to moisture or oxygen molecules. For example, the oxygen and/or moisture barrier material may include metal foils, such as aluminum foil and barrier coatings deposited onto a polymer layer such as metal, silica, alumina and the like. The phrase "barrier coating" refers to a coating that may be applied to one or both surfaces of a film by any known method such as sputtering, vacuum deposition or electroplating (all of which involve some act or method of "depositing" a continuous inorganic material, metal, metal oxide, metal alloy, silicon or silicon oxide layer onto the surface of a polymer substrate). The metal used can vary, though aluminum, zinc, gold, silver or appropriate alloys of such are preferred, with aluminum or aluminum-containing alloys being particularly preferred. As will be recognized by those skilled in the art, while the metal coating predominantly consists of the identified metal (such as aluminum), amounts of other additives may be present to improve assorted physical and optical properties of the deposited metal layer. In one preferred embodiment as depicted in FIG. 8, packaging web 10 includes a five layer structure with polymer layer 25, a barrier layer 45, a laminating adhesive layer 55, an printed ink layer 65, and cold-seal adhesive release layer 70. FIG. 8 illustrates a cross-sectional view of packaging web 10 taken along line C-C of FIG. 7 depicting cold-seal adhesive coating 40 positioned spaced apart from first side edge 11 by second adhesive-free margin 62 and spaced apart from an opposing second side edge 12 by third adhesive-free margin 63. In this embodiment, the product-release coating 50 is applied contiguously within the sealing border 30 to adhesive-free margin 61. In this embodiment, web 10 includes an inner surface formed from polymer layer 25, a barrier layer of deposited metal 45, a layer of laminating adhesive 55, a layer in printed ink 65, a layer of oriented polypropylene, oriented polyethylene terephthalate or oriented polyimide 75, and a cold-seal adhesive release coating 70.

The above description and the following examples illustrate certain embodiments of the present invention and are not to be interpreted as limiting. Selection of particular embodiments, combinations thereof, modifications, and adaptations of the various embodiments, conditions and parameters normally encountered in the art will be apparent to those skilled in the art and are deemed to be within the spirit and scope of the present invention.

WORKING EXAMPLES

In all the following examples, all film structures were produced using a cast coextrusion apparatus and method which are well known to those skilled in the art. The cast coextrusion film apparatus includes a multi-manifold flat die head for film through which the film composition is forced and formed into a flat sheet. The sheet is immediately quenched e.g., via cooled water bath, solid surface and/or air, and then ultimately collapsed and formed into a film.

Specifically, the multilayer films of the present invention and comparative films had the following structures, from the inner (sealing or food contact) layer to the outer (skin or non-food contact) layer:

Example 1

Example 1 is one embodiment of a packaging film of the present invention illustrated in FIGS. 7 and 8 having a structure and layer compositions as described below:

Layer 70 is 100% of a cold-seal adhesive release coating.

Layer 75 is 100% of an oriented polypropylene.

Layer 65 is an ink layer.

Layer 55 is 100% of an urethane acrylic water-based laminating adhesive. This material is commercially available and sold under the trademark Purethane™ A-1090 supplied by Ashland Inc, (Covington, Ky. USA).

Layer 45 is 100% of a barrier layer of deposited aluminum metal.

Layer 25 is 100% of an oriented polypropylene.

Coating 50 is 100% of a product-release coating. This coating is commercially available and sold under the tradename INXClear anti-fog 1309444 by INX International Ink Company (Appleton, Wis., U.S.A.).

Coating 40 is 100% of an acrylic cold-seal adhesive coating. This adhesive is commercially available and sold under the trademark Turbo-Seal C2978B by Bostik, Inc, (Wauwatosa, Wis., U.S.A.).

Layers 70 and 75 were purchased as a single multilayer free-standing film. A non-limiting example of such films is sold under the trademark Bicor™ 75 CSR-2 from Jindal Films, Films Americas LLC (Albany, N.Y., U.S.A.). It is characterized as having a thickness of 75 gauge (19.05 micron), a bulk layer of oriented polypropylene (OPP) and an outer layer of cold-seal release coating. This film will be referred to as freestanding film #1.

Layers 45 and 25 were purchased as a single two-ply free-standing film. A non-limiting example of such films is available under the trademark Metallyte® 50 TSPM OPP Film from Jindal Films, Films Americas LLC (Albany, N.Y., U.S.A.). This film is a 50 gauge high barrier, non-sealable oriented polypropylene (OPP) film having an aluminum metallized first side and an opposing treated second side. This film will be referred to as freestanding film #2.

The film structure as depicted in FIGS. 7 and 8 was produced using methods and techniques generally known in the art. The freestanding film #1 was first reverse printed on the face opposite the release coating. The urethane acrylic water-based laminating adhesive 65 was then applied to layer 66 of freestanding film #1, and was then laminated to the metal layer 45 of freestanding film #2. The product-release coating 50 was then applied to surface 21 of inner layer 25 using standard printing techniques in registration with the printed graphics of film #1 in an amount of 1.7 lbs/ream wet. The product-release coating 50 was dried to remove any residual solvent to a dry weight of between 0.04 and 0.2 lb/ream. Lastly, using standard printing techniques, the acrylic cold-seal adhesive coating 40 was applied to surface 21 of layer 25 in registration with the product release coating 50.

Figure 9:
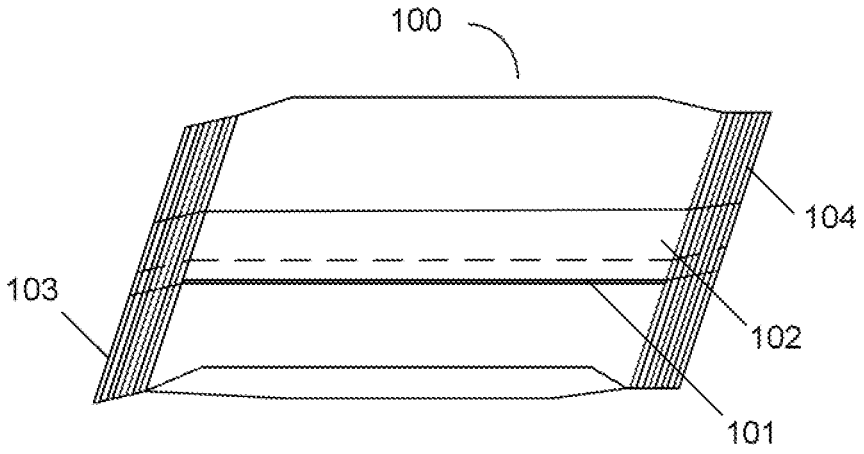
FIG. 9 illustrates a package formed from a packaging web according to the present invention.

FIG. 9 depicts one embodiment of a package 100 fabricated from the packaging webs of the present invention. A horizontal or vertical flow wrap machine may be used to produce the package as depicted in FIG. 9. Preferably, a horizontal flow wrapper machine is used. Once the food product is placed on the flat packaging web where the product-release coating has been applied, the web passes through a forming collar where it is formed into a tube. A set of sealing wheels makes a longitudinal seal 101 by pressing the inner surfaces of the tube together where the cold-seal adhesive coating has been applied thereby forming a fin seal 102. Two cross seals or end seals 103 and 104 are formed through the tube by cross-sealing jaws and the tube is cut above and below each cross seal to individualize the finished package.

What is claimed:

1. A packaging web having a first side edge and an opposing second side edge, a third side edge and opposing fourth side edge, comprising:

a. an inner surface comprising a sealing border positioned adjacent to the first, second, third and fourth side edges and comprising a cold-seal adhesive coating; and b. a product-release coating applied in an area circumscribed by the sealing border, wherein the product-release coating comprises a compound of formula:

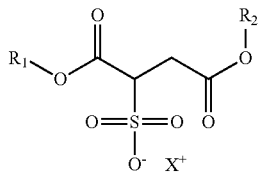

$R_1 + R_2 = C_2$ to $C_{26}$
$X^+$ = Metal cation;

wherein the product-release coating is only applied in an area circumscribed by the sealing border.

2. A packaging web according to claim 1, wherein the product-release composition comprises a sulfosuccinate compound.

3. A packaging web according to claim 1, wherein the metal cation is selected from the group consisting of aluminum, calcium, magnesium, potassium and sodium.

4. A packaging web according to claim 1, wherein the product-release composition comprises a sodium sulfosuccinate compound.

5. A packaging web according to claim 1, wherein the product-release composition is selected from the group consisting of sodium 1, 4-dicyclohexyl sulfosuccinate, sodium 1, 4 dihexyl sulfosuccinate, sodium 1, 4-diisobutyl sulfosuccinate, sodium dioctyl sulfosuccinate, sodium 1, 4-dipentyl sulfosuccinate, sodium 1, 4-ditridecyl sulfosuccinate and blends thereof.

6. A packaging web according to claim 1, wherein the product-release composition comprises sodium dioctyl sulfosuccinate.

7. A packaging web according to claim 1, wherein the inner surface is formed from a polymer layer of polyamide, polyethylene, polyethylene terephthalate or polypropylene.

8. A packaging web according to claim 7, wherein the polymer layer is an oriented polyamide, an oriented polyethylene terephthalate or an oriented polypropylene.

9. A packaging web according to claim 1, wherein the web is a multilayer film.

10. A packaging web according to claim 1, wherein the product-release coating is present on the inner surface in an amount of between 0.02 lb/ream and 0.50 lb/ream.

11. A packaging web according to claim 1, wherein the web has a thickness of at least 1 mil.

12. A packaging web according to claim 1, wherein the inner surface comprises a first adhesive-free margin separating the sealing border from the product-release coating.

13. A packaging web according to claim 12, where the inner surface comprises a second adhesive-free margin separating the first side edge and the sealing border, and a third adhesive-free margin separating the second side edge and the sealing border.

* * * * *